US010920963B2

(12) United States Patent
Ahrari et al.

(10) Patent No.: US 10,920,963 B2
(45) **Date of Patent: *Feb. 16, 2021**

(54) LIGHT FIXTURE HAVING FIXED ANGULAR POSITION AND LAMP MODULE FOR LIGHT FIXTURES

(71) Applicant: Hubbell Incorporated, Shelton, CT (US)

(72) Inventors: Armin Ahrari, Glendale, CA (US); Robert Nankil, Buena Park, CA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/284,657

(22) Filed: Feb. 25, 2019

(65) Prior Publication Data

US 2019/0186715 A1 Jun. 20, 2019

Related U.S. Application Data

(63) Continuation of application No. 14/689,423, filed on Apr. 17, 2015, now Pat. No. 10,215,376.
(Continued)

(51) Int. Cl.
*F21V 1/00* (2006.01)
*F21V 13/12* (2006.01)
(Continued)

(52) U.S. Cl.
CPC ..... *F21V 13/12* (2013.01); *F21S 2/005* (2013.01); *F21S 8/086* (2013.01); *F21S 8/088* (2013.01); *F21V 5/04* (2013.01); *F21V 7/0066* (2013.01); *F21V 11/16* (2013.01); *F21V 19/002* (2013.01); *F21K 9/20* (2016.08); *F21V 7/0091* (2013.01);
(Continued)

(58) Field of Classification Search
CPC ..... F21S 2/005; F21S 8/086
See application file for complete search history.

(56) References Cited

U.S. PATENT DOCUMENTS 2,336,016 A 12/1943 Jayne et al.
2,496,513 A 2/1950 Anders
(Continued)

FOREIGN PATENT DOCUMENTS

| | | |
|---|---|---|
| CN | 202118667 | 1/2012 |
| EP | 1332957 | 8/2003 |
| JP | H06243703 | 9/1994 |

OTHER PUBLICATIONS

Hess "Pasadena Streetlight" Brochure from www.hess.eu/dldfile/Hess_PASADENA_Kat_EN.pdf. Oct. 2011 (12 pages).
(Continued)

*Primary Examiner* — Matthew J. Peerce
(74) *Attorney, Agent, or Firm* — Michael Best & Friedrich, LLP

(57) ABSTRACT

A light fixture includes a housing defining a recessed cavity. The housing has a top, a first side, and a second side each extending at an angle from a first end of the housing to a second end of the housing, the first end being substantially orthogonal relative to a first plane. One or more lamp units are positioned in the housing to emit light therefrom, wherein the emitted light is prevented from leaving the housing in a direction parallel to the first plane.

12 Claims, 9 Drawing Sheets

Related U.S. Application Data

(60) Provisional application No. 61/992,477, filed on May 13, 2014.

(51) Int. Cl.

| | |
|---|---|
| ***F21V 19/00*** | (2006.01) |
| ***F21V 7/00*** | (2006.01) |
| ***F21S 8/08*** | (2006.01) |
| ***F21V 5/04*** | (2006.01) |
| ***F21V 11/16*** | (2006.01) |
| ***F21S 2/00*** | (2016.01) |
| *F21W 131/103* | (2006.01) |
| *F21K 9/20* | (2016.01) |
| *F21Y 103/10* | (2016.01) |
| *F21Y 115/10* | (2016.01) |
| *F21Y 107/60* | (2016.01) |

(52) U.S. Cl.
CPC .... *F21W 2131/103* (2013.01); *F21Y 2103/10* (2016.08); *F21Y 2107/60* (2016.08); *F21Y 2115/10* (2016.08)

(56) References Cited

U.S. PATENT DOCUMENTS

| | | | | |
|---|---|---|---|---|
| 2,800,574 | A | 7/1957 | Belbes et al. | |
| 2,914,657 | A | 11/1959 | Akely et al. | |
| D198,812 | S | 8/1964 | Pettengill | |
| 3,264,465 | A | 8/1966 | Rex | |
| D465,593 | S | 11/2002 | Chang | |
| D493,009 | S | 7/2004 | Ken | |
| D566,876 | S | 4/2008 | Allen | |
| D608,040 | S | 1/2010 | Guercio | |
| D672,078 | S | 12/2012 | Lui | |
| D677,419 | S | 3/2013 | Sauvage | |
| D707,381 | S | 6/2014 | Maxik | |
| 8,858,028 | B2 * | 10/2014 | Kim | F21S 2/005 362/249.02 |
| D729,968 | S | 5/2015 | Szalontai | |
| D732,223 | S | 6/2015 | Ahrari | |
| 9,200,759 | B2 | 12/2015 | Schwarz | |
| D757,322 | S | 5/2016 | Martin | |
| D768,904 | S | 10/2016 | Ahrari | |
| D822,254 | S | 7/2018 | Ahrari | |
| 2005/0237760 | A1 | 10/2005 | Tsukamoto | |
| 2009/0103288 | A1 | 4/2009 | Boyer | |
| 2009/0323343 | A1 | 12/2009 | Wang | |
| 2012/0026728 | A1 | 2/2012 | Lou | |
| 2013/0003379 | A1 | 1/2013 | DeSilva | |
| 2013/0083534 | A1 * | 4/2013 | Chen | F21V 21/14 362/249.03 |
| 2013/0301267 | A1 | 11/2013 | Badley | |
| 2013/0322074 | A1 | 12/2013 | Guercio et al. | |
| 2014/0078715 | A1 | 3/2014 | Pickard | |
| 2014/0168991 | A1 | 6/2014 | Kim | |
| 2014/0334148 | A1 | 11/2014 | Lee | |
| 2014/0347856 | A1 | 11/2014 | Deng | |
| 2015/0330609 | A1 | 11/2015 | Ahrari | |

OTHER PUBLICATIONS

European Patent Appl. No. 15792109.9 extended European Search Report dated Oct. 6, 2017 (8 pages).
PCT/US2015/030316 International Search Report and Written Opinion dated Sep. 17, 2015.
Hess "Pasadena" Luminaire Brochure pp. 147-151 from hessamerica.com. Available Apr. 9, 2015 (5 pages0 (Year 2015).
Indian Patent Application No. 201637038715 Examination Report dated Jan. 21, 2020 (6 pages).

* cited by examiner

LIGHT FIXTURE HAVING FIXED ANGULAR POSITION AND LAMP MODULE FOR LIGHT FIXTURES

REFERENCE TO RELATED APPLICATIONS

This application is a continuation of co-pending, prior-filed U.S. patent application Ser. No. 14/689,423, filed Apr. 17, 2015, which claims the benefit of U.S. Provisional Patent Application Ser. No. 61/992,477, filed May 13, 2014. The contents of these documents are incorporated herein by reference.

FIELD

Exemplary embodiments relate to light fixtures, for example external light fixtures designed to illuminate streets, paths, parking lots, or other areas.

BACKGROUND

Light fixtures, or luminaires, are used with electric light sources to provide aesthetic and functional housing in both interior and exterior applications. One type of light fixture is a street lamp, generally used for exterior lighting of roads, walkways, parks, parking lots, or other large areas requiring a significant amount of lighting. Street lamps typically include a light fixture attached to pole or post to provide an elevated lighting position. In recent years, lighting applications, including street lamps have trended towards the use of light emitting diodes (LEDs) as a light source in place of conventional incandescent and fluorescent lamps.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
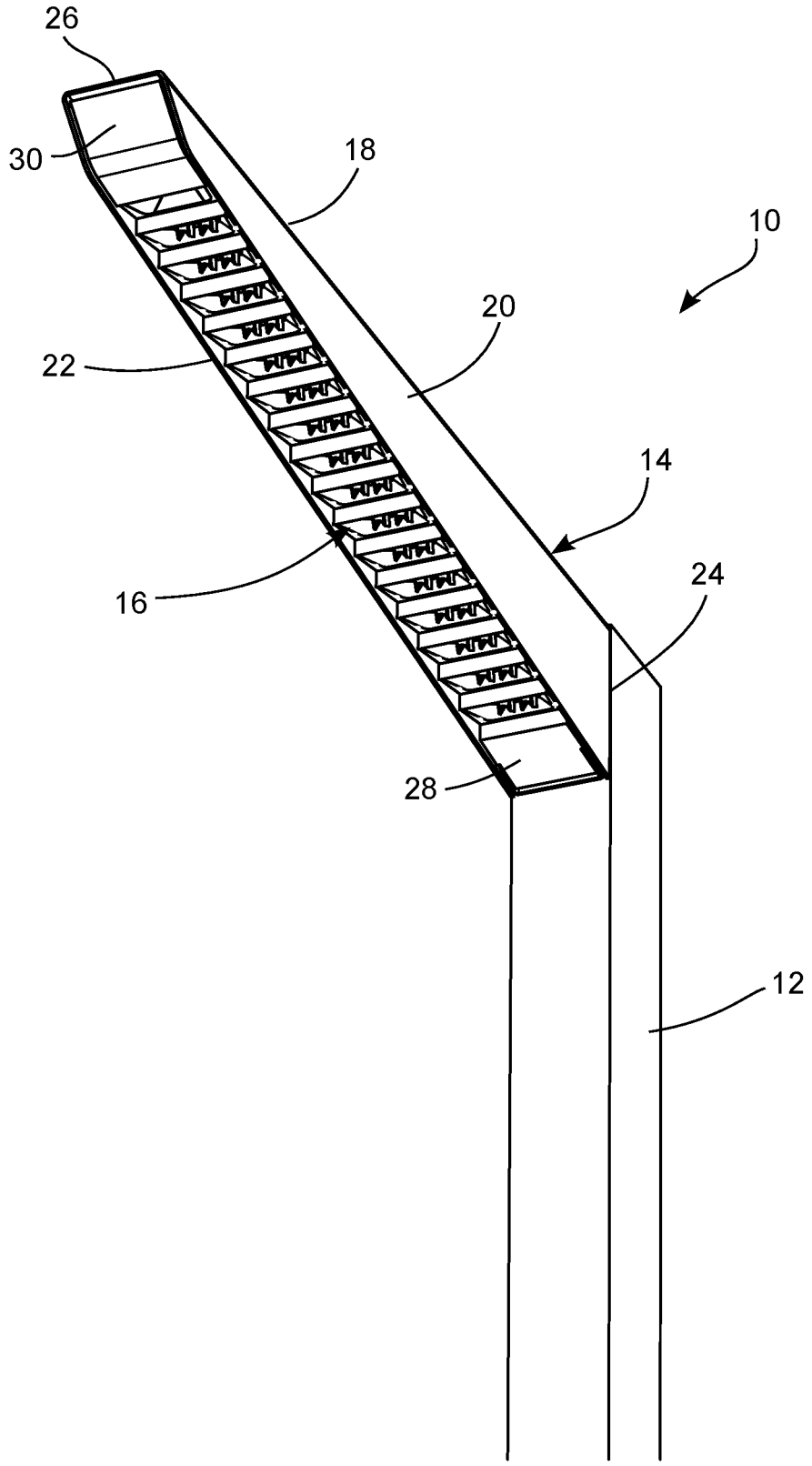
FIG. 1 is a perspective view of an exemplary light fixture mounted to the side of a pole.
Figure 2:
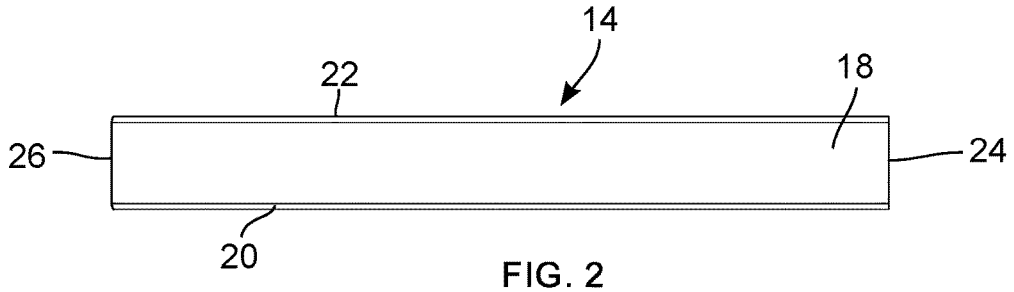
FIG. 2 is a top view of the light fixture of FIG. 1.
Figure 3:
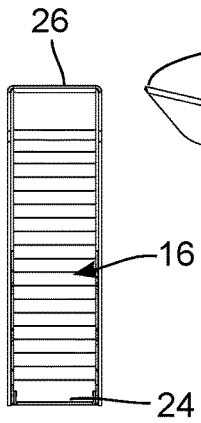
FIG. 3 is a front elevation of the light fixture of FIG. 1.
Figure 4:
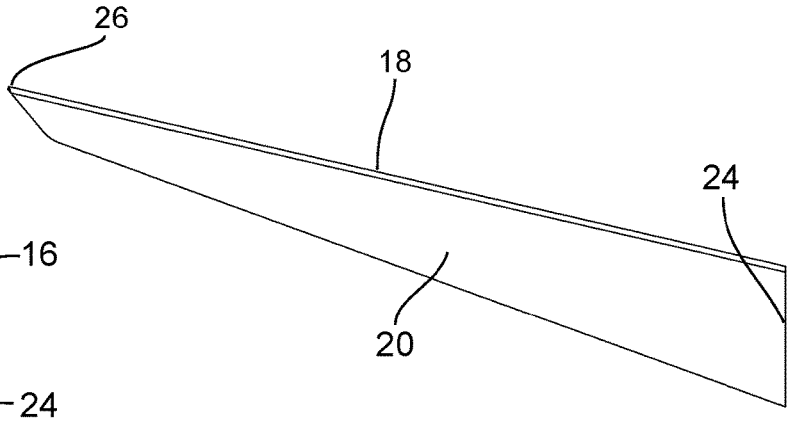
FIG. 4 is a side view of the light fixture of FIG. 1.
Figure 5:
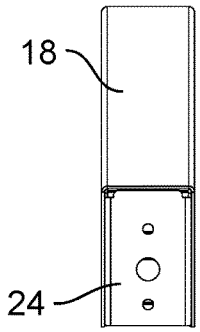
FIG. 5 is a rear view of the light fixture of FIG. 1.
Figure 6:
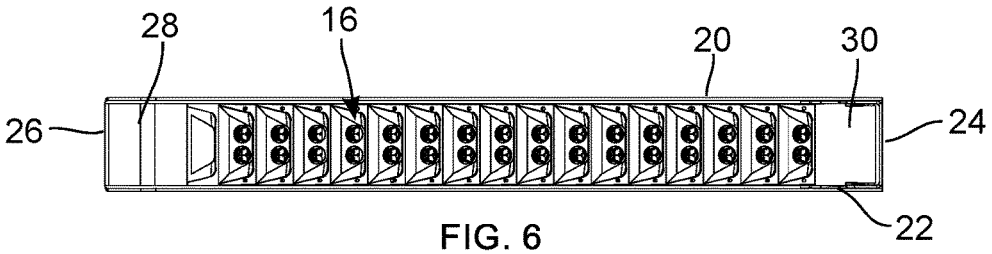
FIG. 6 is a bottom view of the light fixture of FIG. 1.
Figure 7:
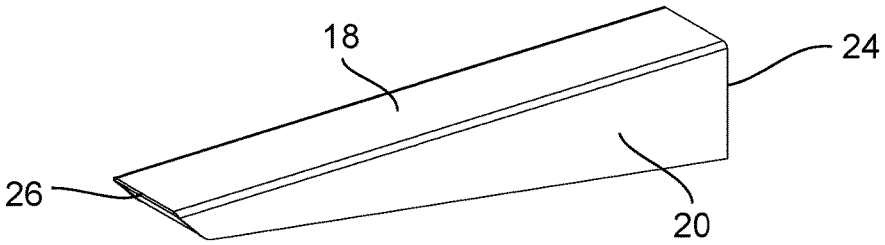
FIG. 7 is a top perspective view of the light fixture of FIG. 1.
Figure 8A:
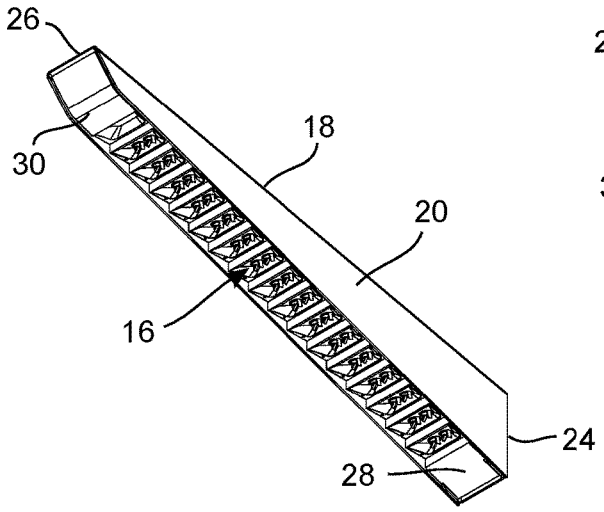
FIG. 8A is a bottom perspective view of the light fixture of FIG. 1.
Figure 8B:
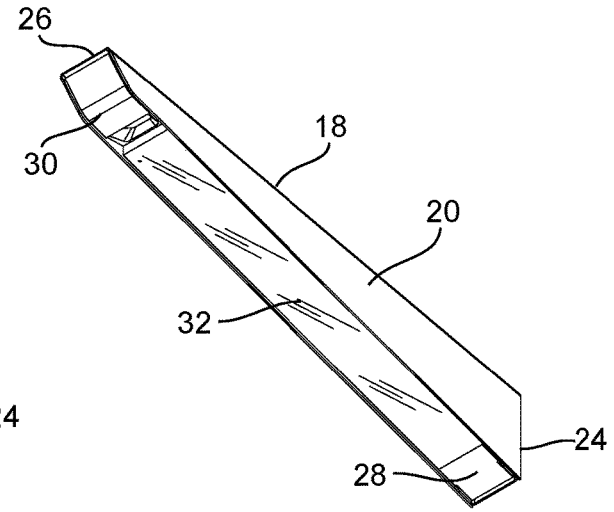
FIG. 8B is a bottom, perspective view of the light fixture of FIG. 1 with an outer lens.

In accordance with an exemplary embodiment depicted in FIG. 1, a light fixture assembly 10 is connected to a support, for example a pole 12 extending vertically from the ground (not shown). In various alternative embodiments, the support may be any stable structure, such as a wall or a beam. The light fixture assembly 10 includes a housing 14 having a cavity for retaining one or more compartmentalized, recessed lamp units 16. The housing 14 extends from the pole 12 and includes a first end adjacent and connected to the pole 12 and a second end distal to the pole 12. The housing 14 extends obliquely from the pole 12, outwardly and away from the ground and emits light downwardly. In various exemplary embodiments, the housing 14 and the lamp units 16 prevent light from being emitted in a direction parallel to the ground and/or above the light fixture relative to the ground.

As best shown in FIGS. 2-10, and in accordance with various exemplary embodiments, the housing 14 includes a top 18, a first side 20, and a second side 22. The first and second sides 20, 22 extend from the top 18 toward the ground. A chamfered edge connects the first and second sides 20, 22 with the top 18. The first and second sides 20, 22 taper from a first height at a base 24 adjacent the pole to a second height at a tip 26 at the opposite end. The first and second sides 20, 22 have a bottom edge with a first section having a first angle of inclination relative to the post 12 and a second section having a second angle of inclination relative to the post greater than the first angle. The first and second sections meet at a curved transition, although in other embodiments, the first and second sections meet directly. In the embodiments shown in FIGS. 8A, 8B, the housing 14 includes a first end cap 28 and a second end cap 30 bordering the lamp units 16. An outer diffuser or lens 32 can be connected to the housing 14 as shown in FIG. 8B.

Figure 9:
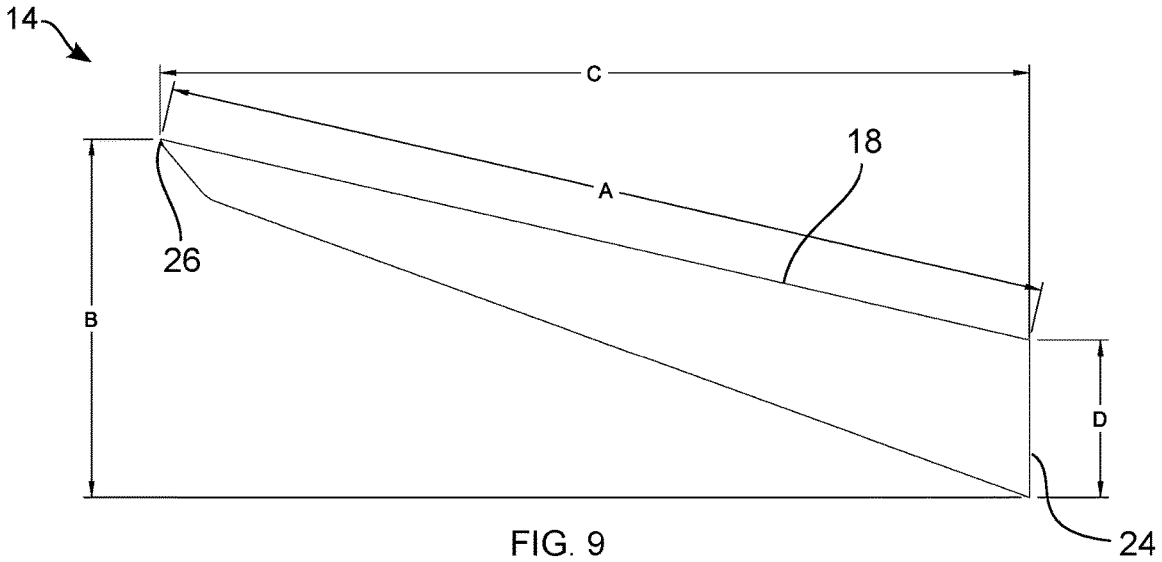
FIG. 9 is a side view of the light fixture of FIG. 1 with exemplary dimensional representations of the length of the top, the height from the base to the tip, the horizontal length, and the height of the base.
Figure 10:
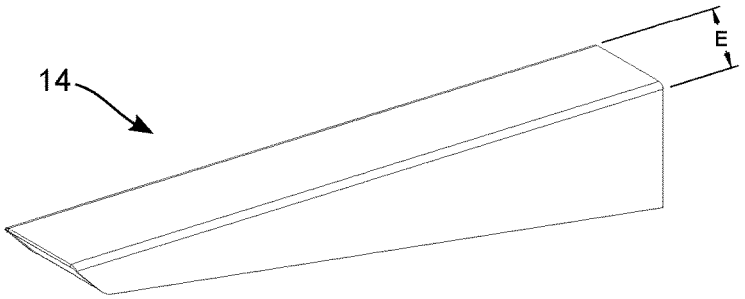
FIG. 10 is a perspective view of the light fixture of FIG. 1 with an exemplary dimensional representation of the width of the top.
Figure 11:
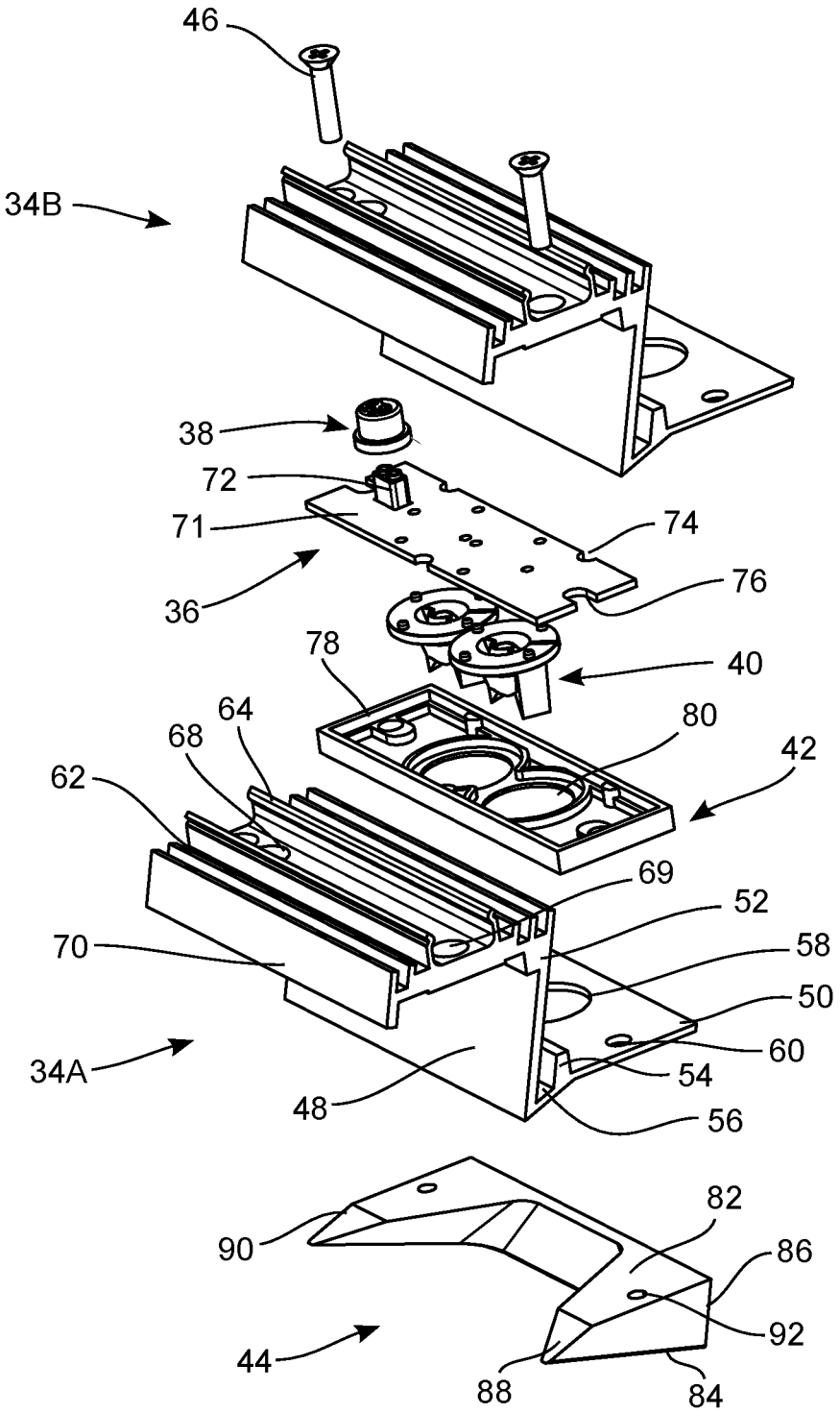
FIG. 11 is an exploded, perspective view of an exemplary lamp unit and a first and second bracket.
Figure 12:
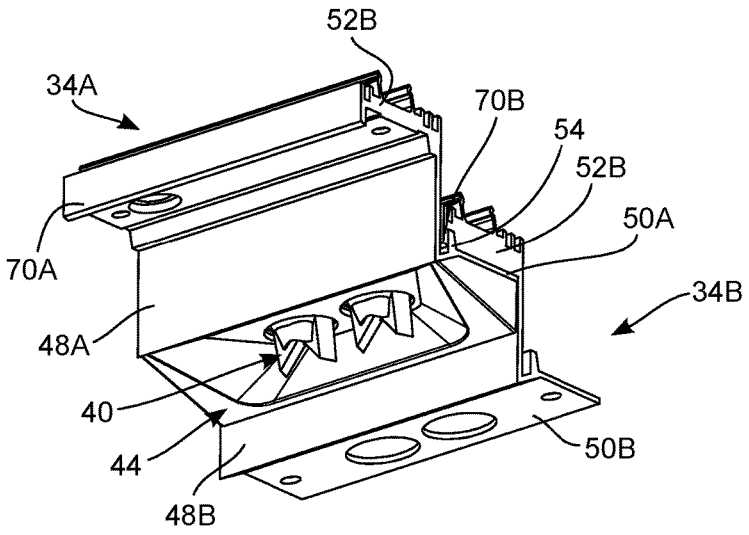
FIG. 12 is a bottom, perspective view of the lamp unit of FIG. 11 connected to the second bracket.
Figure 13:
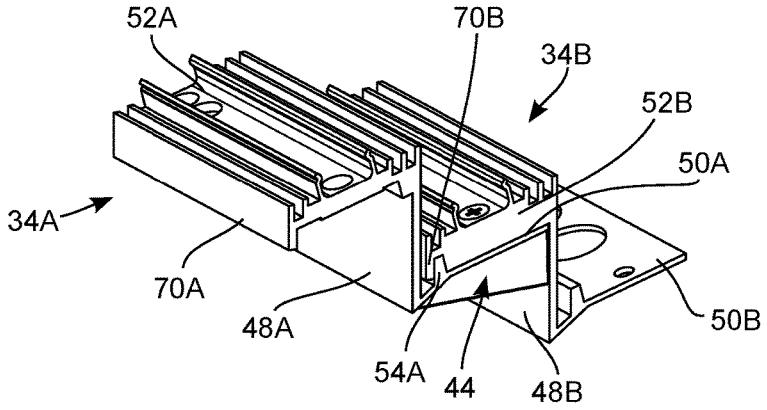
FIG. 13 is a top, perspective view of the lamp unit and the first and second brackets of FIG. 12.
Figure 14:
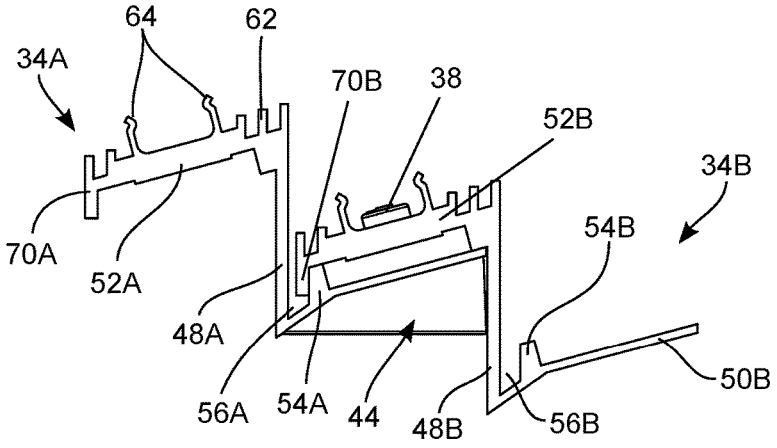
FIG. 14 is a side view of the lamp unit and the first and second brackets of FIG. 12.

FIGS. 9-10 illustrate an exemplary embodiment of the housing 14 configured to provide an angled transition from the pole 12 while preventing light from being emitted parallel to the ground and/or upward relative to the ground. The housing 14 has a top 18 with length A, an overall height B measured from the bottom of the base 24 to the top of the tip 26, an overall horizontal length C from the first end to the second end, a height D of the base 24, and the top 18 has a width E. The top width E is configured to be substantially the width of the pole 12. In an exemplary embodiment the top width E is approximately 4.0-5.0 inches. Dimension B is configured to have an approximately 0.4 ratio to dimension A, dimension C is configured to have an approximately 0.98 ratio to dimension A, and dimension D is configured to have an approximately 0.18 ratio to dimension A. According to further exemplary embodiments, the housing 14 has different dimensions as indicated in table 1 where K4 represents an exemplary 4 inch wide luminaire and K5 represents an exemplary 5 inch wide luminaire:

TABLE 1

| | K4 | RATIO TO A | K5 | RATIO TO A |
|---|---|---|---|---|
| A | 34.084 | | 41.084 | |
| B | 13.7 | 0.40 | 16.106 | 0.39 |
| C | 33.24 | 0.98 | 40.031 | 0.97 |
| D | 6.03 | 0.18 | 6.864 | 0.17 |

In various exemplary embodiments, a cavity within the housing 14 receives one or more modular lamp units 16. For example, the light fixture assembly 10 illustrated in FIGS. 11-14 includes a first bracket 34A, an LED board 36, a conductor grommet 38, one or more optics 40, a gasket 42, and a reflector 44. The first bracket 34A is configured to connect to a similar or identical second bracket 34B, for example through a mechanical connection such as a mating fit, an interference fit, or a snap fit. One or more mechanical fasteners 46 may be used to hold the first bracket 34A to the second bracket 34B and to secure one or more of the other elements in the lamp unit 16. The brackets 34A, 34B mate to form a stair-like pattern where each additional bracket is spaced outwardly and above the previous bracket. In this way, a single lamp unit 16 may be manufactured and adapted for use with various sized light housings 14. In the interest of clarity and brevity, similar parts on the brackets 34A, 34B are described and labeled only once. As necessary, similar parts of the brackets 34A, 34B are designated with the same number with either an A or a B designation.

The bracket 34A includes a wall 48, a bottom member 50 extending from the wall 48 in a first direction and a top member 52 extending from the wall 48 in the second direction, giving the bracket 34A an approximately Z-shaped configuration. In an exemplary embodiment, the bottom and top members 50, 52 are substantially rectangular plates. The bracket 34A is made from a rigid material, for example aluminum or other suitable metal, polymer, or composite material. The bracket 34A may be formed through machining, extrusions, molding, or other suitable processes.

The wall 48 of the bracket 34A extends between the bottom member 50 and the top member 52. The wall 48 may be substantially vertical, orthogonal to the ground, or the wall 48 may have an angle of inclination relative to a vertical axis, for example between 0 and 10 degrees in either direction. The wall 48 has a front surface and a rear surface. The size, shape, and configuration of the wall 48 can be changed depending on the housing 12, the light source (not shown), and other design and utility considerations.

The bottom member 50 extends obliquely from the bottom of the wall 48 in a first direction. In the exemplary embodiment shown, the bottom member 50 extends at an acute angle relative to the rear surface of the wall. The bottom member 50 has a first section with a first angle of inclination to the wall 48 and a second section with a second angle of inclination greater than the first angle of inclination relative to the wall 48. A first projection 54 extends from the bottom member 50 towards the top member 52 continuously along the width of the bottom member 50. In alternative embodiments, the height, shape, length, and position of the first projection 54 may vary according to the needs of the light source and the housing 14 and on the various types of required connections.

A groove 56 is bound on one side by the first projection 54 and on the other side by the wall 48. The bottom member 50 includes one or more light apertures 58 for receiving a light source and/or an optic 40 associated with a light source. The bottom member 50 also includes one or more fastener apertures 60 for receiving a mechanical fastener 46. The exemplary embodiment shown in FIGS. 11-14 depicts two light apertures 58 and two fastener apertures 60. The size, shape, and configuration of the bottom member 50 may vary according to the light source, the housing 14, and other design and utility considerations.

The top member 52 extends obliquely from the top of the wall 48 in the second direction. In the exemplary embodiment shown, the top member 52 extends at an acute angle relative to the front surface of the wall. One or more heat fins 62 extend from the top surface of the top member 52 to dissipate heat generated by the light source. A set of tines 64 also extend from the top surface of the top member 52 bounding a channel. The top member 52 includes a conductor aperture 68 to receive the conductor grommet 38 and one or more fastener openings 69 to receive a mechanical fastener 46. The conductor aperture 68 allows conductors to pass through the top member 52 and connect to the LED board 36. The conductor grommet 38 protects the conductor passing through the bracket 34A from wear. The conductor grommet 38 may be made from a suitable polymer or elastomer material, for example silicone. A second projection 70 extends from the top member 52 in the direction of the bottom member 50. The second projection 70 is configured to mate with the groove 56 and/or the first projection 54 of the bottom member 50 to form a connection with an identical or similarly configured bracket 34B.

The LED board 36 contains a printed circuit board (PCB) 71 and one or more light sources (not shown), for example LED light sources. The PCB 71 and the light source are included in the exemplary light source assembly, although other light emitting configurations may be used. A conductor connection port 72 extends from the PCB 71 for receiving an electrical conductor (not shown), electrically connecting the LED board 36 to a power source, such as a driver (not shown). The PCB 71 includes one or more traces or pathways extending from the connection port 72 to the light sources. One or more slots 74 are provided that allow the LED board 36 to be easily positioned and retained relative to the gasket 42. According to this and other embodiments, the LED board 36 includes one or more apertures or slots 76 to receive a mechanical fastener 46. The various sizes and shapes of the LED board 36 as well as the various light sources, materials, and other configurations used in connection with the LED board 36 would be understood by one of ordinary skill in the art when viewing this disclosure. In various exemplary embodiments, the bracket 34A and the housing 14 are utilized with other light sources, for instance, other solid state, electrical filament, fluorescent, plasma, or gas light sources.

An optic 40 is connected to the LED board 36, for example through a set of pins and an adhesive. The optic 40 encloses the light source and directs and/or diffuses light emitted therefrom. The optic 40 is made from a polymer material, for example polycarbonate or polymethyl methacrylate. In various exemplary embodiments, the optic 40 is a total internal reflection lens. Different types of optics 40 may be utilized depending on the lights source, the desired emitted light, and other design and utility considerations.

Two optics 40 are shown in the exemplary embodiment, although more or less may be utilized depending on the number of light sources and the desired light output.

The gasket 42 has an outer flange 78 that receives at least a portion of the LED board 36 and one or more apertures 80 to receive at least a portion of the optic 40. The gasket 42 is selectively configured to include other protrusions, flanges, and openings depending on the configuration of the lamp unit 16. The gasket 42 may be made from a material suitable to receive and protect the LED board 36, for example a polymer or an elastomer such as silicone.

The reflector 44 connects to the bracket 34A and at least partially surrounds the light source and directs light emitted therefrom. The reflector 44 has a top surface 82, a bottom surface 84, and base 86 at a first end. A first arm 88 and a second arm 90 extend from the base 86 to a second end, giving the reflector 44 a substantially U-shaped configuration surrounding an opening. There is a rounded or angled transition between the first and second arms 88, 90 and the base 86. The first and second arms 88, 90 taper to a point in the direction of the second end, both along their width and height. The taper along the width increases the size of the opening from the top surface 82 to the bottom surface 84. In an exemplary embodiment, the bottom surface 84 is substantially planar and extends substantially parallel to the ground when positioned in the housing 14. The top surface 82 has a first section with a first angle of inclination and a second section with a second angle of inclination greater than the first section. The reflector 44 includes one or more apertures 92 for receiving a mechanical fastener 46 to connect the reflector 44 to the bracket 34A.

In operation, one or more brackets 34 may be combined in a housing 14 to form separate lamp units 16. The gasket 42 is placed around the LED board 36 so the optic 40 extends at least partially through the gasket 42. The LED board 36 and gasket 42 are placed on the top surface of the bottom member 50 of the first bracket 34A with the optics 40 extending through the light apertures 58. The reflector 44 is placed on the bottom surface of the bottom member 50 of the first bracket 34A. The second bracket 34B is positioned adjacent the first bracket 34A so that the top member 52 of the second bracket 34B is positioned over the bottom member 50 of the first bracket 34A. The first and second projections 54, 70 are mated so that the second projection 70 extends into the groove 56 adjacent the first projection 54. The first and second projections 54, 70 may be in contact with one another. The silicone conductor grommet 38 is positioned in the conductor aperture 68 of the top member 52 and the PCB conductor port 72 extends at least partially into the silicone conductor grommet 38. The fasteners 46 are inserted through the top member 52 of the second bracket 34B, the gasket 42, the bottom member 50 of the first bracket 34A, and into the reflector 44.

Figure 15:
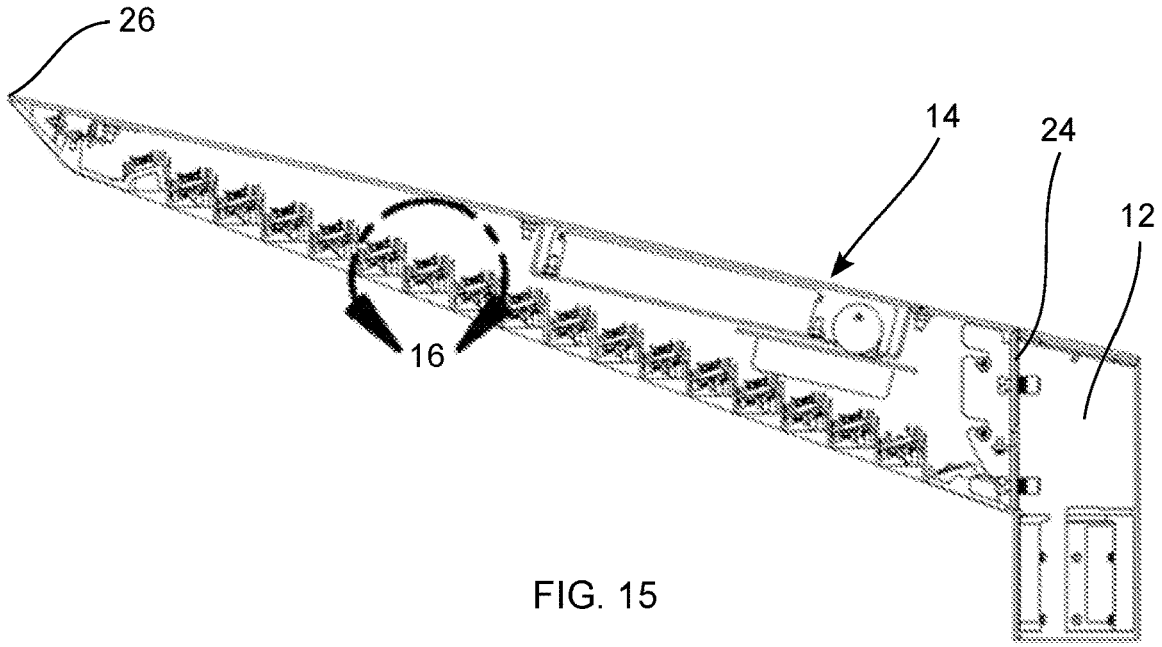
FIG. 15 is a side, sectional view of the exemplary light housing of FIG. 1.
Figure 16:
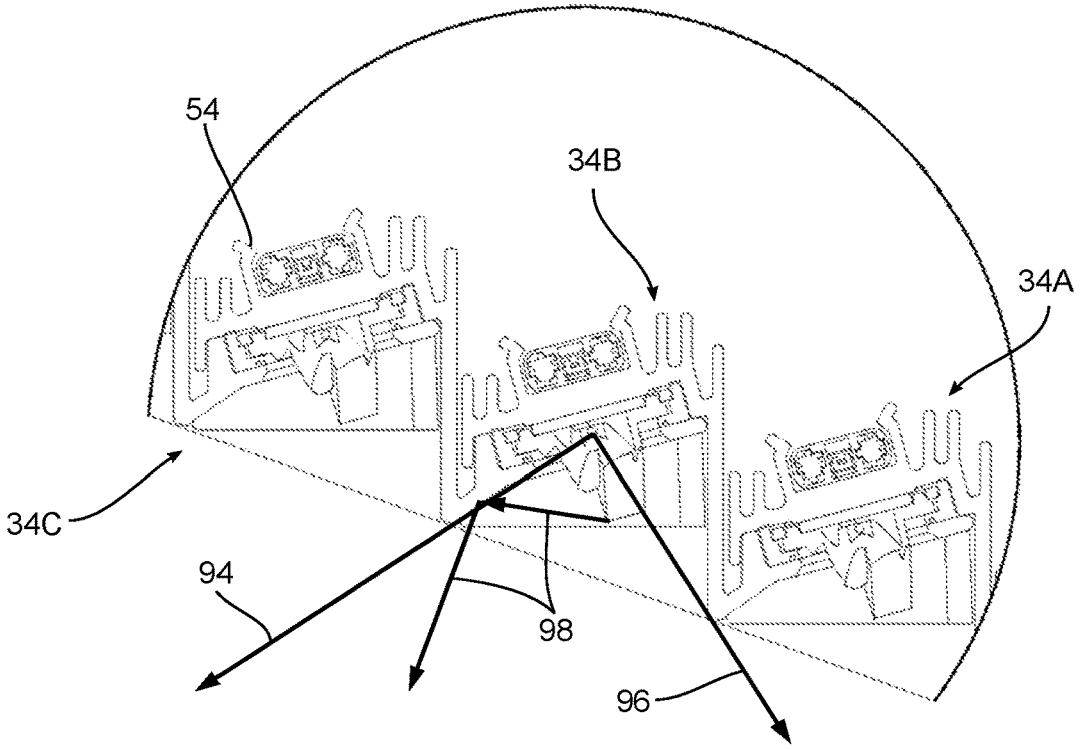
FIG. 16 is a partial, enlarged view of the light housing of FIG. 15 taken about the area labeled 16.
Figure 17:
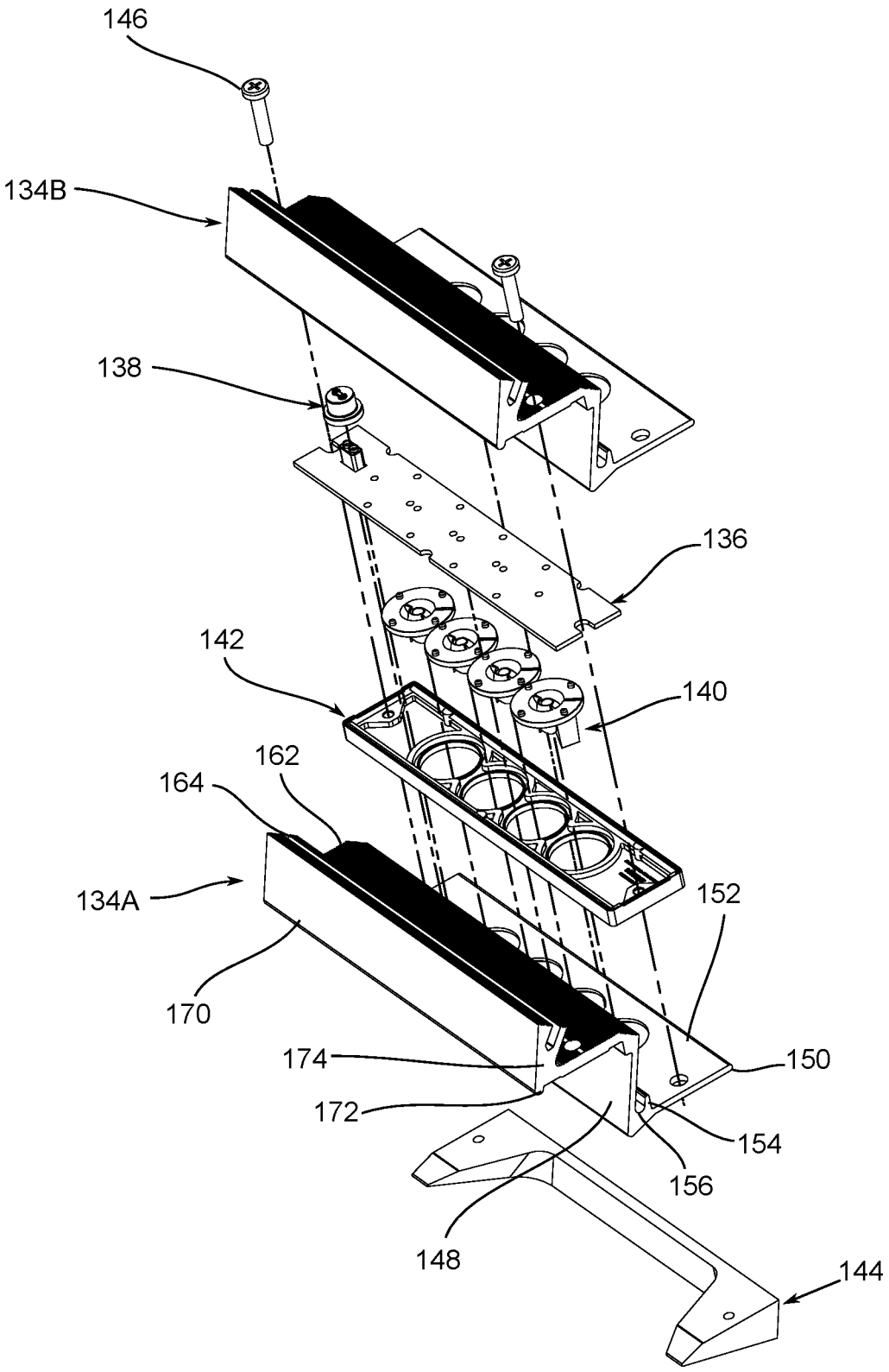
FIG. 17 is an exploded, perspective view of another exemplary lamp unit and exemplary first and second brackets.

As best shown in FIGS. 15 and 16, a plurality of lamp units 16, which include one or more brackets 34, are connected together in the housing 14 and the housing 14 is connected to a post 12, for example by one or more mechanical fasteners. The brackets 34 are connected together sequentially in a stair-like fashion, with each subsequent bracket 34 connected with the previous one. Lamp units 16 having identical or similar brackets 34 may be utilized in making the connection. In various alternative embodiments, the brackets 34 are not identical but have a common mating feature, for example the first and second protrusions 54, 70 and the aligned fastener openings 60, 69. Other suitable mating features may be used as would be understood by one of ordinary skill in the art.

The lamp units 16 extend along the housing 14, at an angle from the post 12 and upwards away from the ground. The lamp units 16 and the housing 14 prevent light from being emitted out of the housing 14 parallel to the ground and above the housing 14 relative to the ground. The light may be prevented from being emitted parallel to the ground in the front of the housing 14, from the sides of the housing 14, or a combination of both. In various exemplary embodiments, the reflector 44, optic 40, and brackets 34A, 34B combine to prevent light from being emitted parallel to the ground in front of the housing 14 and from the side of the housing 14, while the lamp units 16 are recessed in the housing 14 to prevent light from being emitted above the housing 14. The housing 14 may also assist in preventing light from being emitted parallel to the ground from the side of the housing 14.

FIG. 16 depicts the path of some light emitted from the housing 14 in accordance with various exemplary embodiments. Arrows 94 and 96 represent the bounded area of light that is emitted from the light source that can leave the housing due to the configuration of the brackets 34A-34C. Arrow 98 represents light that is directed from the optic 40. Instead of being emitted from the housing 14 parallel to the ground, the light represented by arrow 98 strikes the bracket 34C and is directed downward towards the ground. Arrows 94, 96, 98 represent only a portion of the light emitted from the light source as would be understood by one of ordinary skill in the art.

FIGS. 17-20 show another exemplary embodiment of a first bracket 134A, a second bracket 134B, an LED board 136, a conductor grommet 138, one or more optics 140, a gasket 142, and a reflector 144. The first bracket 134A is configured to connect to a similar or identical second bracket 134B, for example through a mechanical connection such as a mating fit, an interference fit, or a snap fit. One or more mechanical fasteners 146 may be used to hold the first bracket 134A to the second bracket 134B and to secure one or more of the other elements in the lamp unit. The brackets 134A, 134B mate to form a stair-like pattern where each additional bracket is spaced outwardly and above the previous bracket.

The bracket 134A includes a wall 148, a bottom member 150 extending from the wall 148 in a first direction and a top member 152 extending from the wall 148 in a second direction, giving the bracket 134A an approximately Z-shaped configuration. In an exemplary embodiment, the bottom and top members 150, 152 are substantially rectangular plates. The bracket 134A is made from a rigid material, for example aluminum or other suitable metal, polymer, or composite material. The bracket 134A may be formed through machining, extrusions, molding, or other suitable processes.

The wall 148 of the bracket 134A extends between the bottom member 150 and the top member 152. The wall 148 may be substantially vertical, orthogonal to the ground, or the wall 148 may have an angle of inclination relative to a vertical axis, for example between 0 and 10 degrees in either direction. The wall 148 has a front surface and a rear surface. The size, shape, and configuration of the wall 148 can be changed depending on the housing 12, the light source (not shown), and other design and utility considerations.

The bottom member 150 extends obliquely from the bottom of the wall 148 in the first direction. In the exemplary embodiment shown, the bottom member 150 extends at an acute angle relative to the rear surface of the wall 148. The bottom member 150 has a first section with a first angle of inclination to the wall 148 and a second section with a second angle of inclination greater than the first angle of inclination relative to the wall 148. A first projection 154 extends from the bottom member 150 towards the top member 152 continuously along the width of the bottom member 150. In alternative embodiments, the height, shape, length, and position of the first projection 154 may vary according to the needs of the light source and the housing 14 and on the various types of required connections.

A groove 156 is bound on one side by the first projection 154 and on the other side by the wall 148. In an exemplary embodiment, the groove 156 has a substantially rounded bottom. The bottom member 150 includes one or more light apertures 158 for receiving a light source and/or an optic 140 associated with a light source. The bottom member 150 also includes one or more fastener apertures 160 for receiving a mechanical fastener 146. The exemplary embodiment shown in FIGS. 17-20 depicts four light apertures 158 and four fastener apertures 160. The size, shape, and configuration of the bottom member 150 may vary according to the light source, the housing 14, and other design and utility considerations.

The top member 152 extends obliquely from the top of the wall 148 in the second direction. In the exemplary embodiment shown, the top member 152 extends at an acute angle relative to the front surface of the wall. One or more heat fins 62 extend from the top member 152 to dissipate heat generated by the light source. The top member 152 includes a conductor aperture to receive the conductor grommet 138 and one or more fastener openings to receive a mechanical fastener 146. The conductor aperture allows conductors to pass through the top member 152 and connect to the LED board 136. The conductor grommet 138 protects the conductor passing through the bracket 134A from wear.

Figure 18:
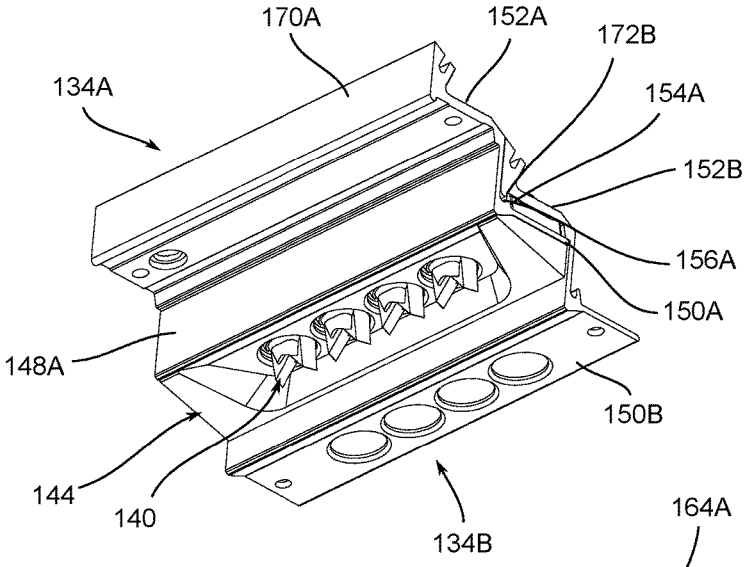
FIG. 18 is a bottom, perspective view of the lamp unit of FIG. 17 connected to the second bracket.
Figure 19:
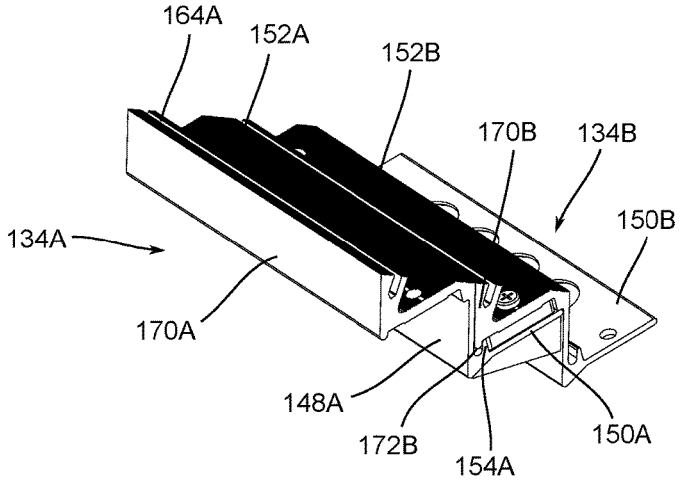
FIG. 19 is a top, perspective view of the lamp unit and the first and second brackets of FIG. 18.
Figure 20:
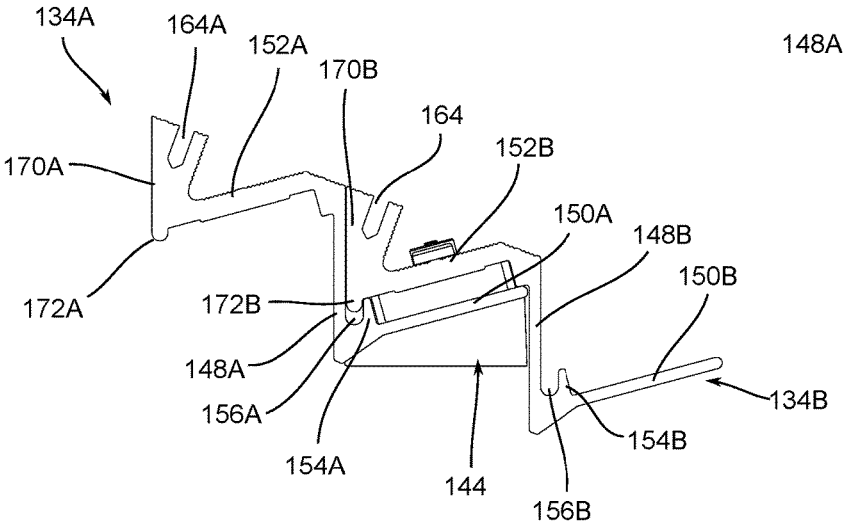
FIG. 20 is a side view of the lamp unit and the first and second brackets of FIG. 18.

A second projection 170 extends from the top member 152 in the direction of the bottom member 150. As best shown in FIGS. 18-20, the second projection 170 is configured to mate with the groove 156 and/or the first projection 154 of the bottom member 150 to form a connection with an identical or similarly configured bracket 134B. In the exemplary embodiment, the second projection includes a rounded portion 172 that extends below the top member 152 and an upper portion 174 that extends above the top member 152. When two brackets 134A, 134B are connected, a face or outer surface of the upper portion 174 is positioned in contact with or substantially adjacent to a surface of the wall 148. In an exemplary embodiment, the top of the upper portion 174 has a first angled surface and a rear section of the top member 152 has a second angled surface. When two brackets 134A, 134B are connected, the first and second angled surfaces are aligned and have a consistent slope. A second groove 164 can be formed in the upper portion 174.

Figure 21:
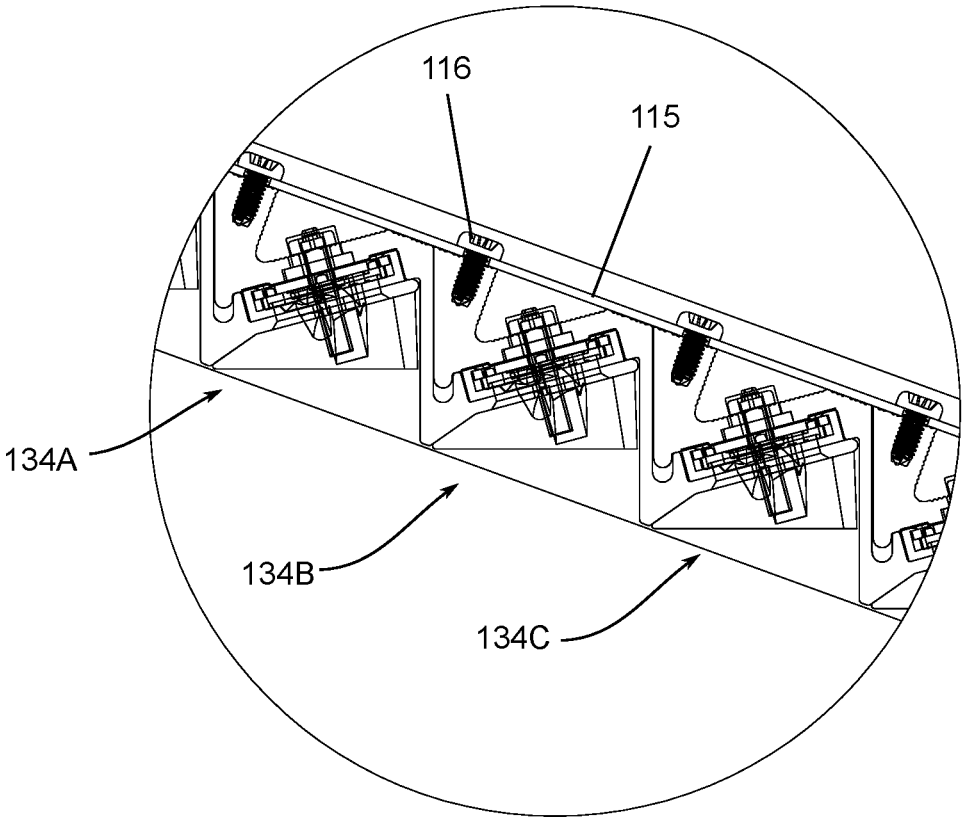
FIG. 21 is a partial, enlarged sectional view of a series of lamp units in an exemplary housing.

As best shown in the exemplary embodiment of FIG. 21, two or more brackets 134A-C are combined in a housing 114 to form separate lamp units. The LED board 136 and gasket 142 are placed on the top surface of the bottom member 150 of the first bracket 134A with the optics 140 extending through the light apertures 158. The reflector 144 is placed on the bottom surface of the bottom member 150 of the first bracket 134A. The second bracket 134B is positioned adjacent the first bracket 134A so that the top member 152 of the second bracket 134B is positioned over the bottom member 150 of the first bracket 134A. The first and second projections 154, 170 are mated so that the second projection 170 extends into the groove 156 adjacent the first projection 154. The first and second projections 154, 170 may be in contact with one another. The fasteners 146 are inserted through the top member 152 of the second bracket 134B, the gasket 142, the bottom member 150 of the first bracket 134A, and into the reflector 144. A backing member 115 can also be connected to the brackets 134A-C. One or more fasteners 116 are inserted through the backing member 115 and connected to the brackets 134A-C, for example by being inserted into the second slot 164. The second slot can include threads for engaging the fasteners 116, or self-taping fasteners can be used. The backing member 115 can provide rigidity and support the bracket assembly.

The lamp units extend along the housing 114, at an angle and upwards away from the ground. The lamp units and the housing 114 prevent light from being emitted out of the housing 114 parallel to the ground and above the housing 114 relative to the ground. The light may be prevented from being emitted parallel to the ground in the front of the housing 114, from the sides of the housing 114, or a combination of both. In various exemplary embodiments, the reflector 144, optic 140, and brackets 134A, 134B combine to prevent light from being emitted parallel to the ground in front of the housing 114 and from the side of the housing 114, while the lamp units are recessed in the housing 114 to prevent light from being emitted above the housing 114. The housing 114 may also assist in preventing light from being emitted parallel to the ground from the side of the housing 114.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the exemplary claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A light fixture comprising:

an elongated housing including a first end configured to be coupled to a support member in a cantilevered manner and a second end spaced apart from the first end, the housing including an upper surface, a first side, and a second side, a housing axis extending between the first end of the housing and the second end of the housing and oriented at an acute angle relative to a horizontal plane; and a plurality of lamp units supported in the housing to emit light therefrom, each lamp unit positioned proximate a lower surface of the housing opposite the upper surface, each lamp unit oriented toward the first end of the housing, the lamp units inhibiting light emitted from the lamp units from leaving the housing in a direction parallel to the horizontal plane and away from the first end of the housing;

wherein the plurality of lamp units includes a first lamp unit and a second lamp unit, the first lamp unit having a first bracket and a first light emitter, the second lamp unit having a second bracket and a second light emitter, the first bracket coupled to the second bracket;

wherein the second bracket is coupled to the first bracket such that a portion of the second bracket is in direct overlapping contact with a portion of the first bracket, wherein the first light emitter and the second light emitter are oriented in the same orientation, the second light emitter being laterally offset from the first light emitter and vertically offset from the first light emitter.

2. The light fixture of claim 1, wherein the housing and the one or more lamp units prevent light from leaving the housing above the housing relative to the first plane.

3. The light fixture of claim 1, wherein adjacent lamp units are connected to one another in a stair-like manner.

4. The light fixture of claim 1, wherein the first bracket includes a lower end having a first mating feature and an upper end having a second mating feature, the second bracket including a lower end having a third mating feature and an upper end having a fourth mating feature, the fourth mating feature directly engaging the first mating feature.

5. The light fixture of claim 4, wherein the first light emitter is positioned between the upper end and the lower end of the first bracket.

6. The light fixture of claim 1, wherein the plurality of lamp units further includes a third lamp unit, the second lamp unit coupled sequentially between the first lamp unit and the third lamp unit.

7. The light fixture of claim 1, wherein the housing includes a base at the first end and a tip at the second end, a ratio of a height from the base to the tip relative to a length of the upper surface is 0.4, a ratio of a height of the base to the length of the upper surface is 0.18, and a ratio of a length from the first end to the second end relative to the length of the upper surface is 0.98.

8. A light fixture comprising:

an elongated housing including a first end configured to be coupled to a support member in a cantilevered manner and a second end spaced apart from the first end, the housing including an upper surface, a first side, and a second side, a housing axis extending between the first end of the housing and the second end of the housing and oriented at an acute angle relative to a horizontal plane; and a plurality of lamp units, including a first lamp unit and a second lamp unit, supported in the housing to emit light therefrom, each lamp unit positioned proximate a lower surface of the housing opposite the upper surface, each lamp unit oriented at an acute angle relative to a vertical direction and oriented toward the first end of the housing;

wherein the first lamp unit has a first bracket, the second lamp unit has a second bracket, and the first bracket is directly coupled to the second bracket such that a portion of the second bracket is in direct overlapping contact with a portion of the first bracket.

9. The light fixture of claim 8, wherein the adjacent lamp units are connected to one another in a stair-like manner.

10. The light fixture of claim 8, wherein the first bracket includes a lower end having a first mating feature and an upper end having a second mating feature, the second bracket including a lower end having a third mating feature and an upper end having a fourth mating feature, the fourth mating feature directly engaging the first mating feature, wherein the first lamp unit includes a first light emitter positioned between the upper end and the lower end of the first bracket.

11. The light fixture of claim 8, wherein the plurality of lamp units inhibit light emitted from the lamp units from leaving the housing in a direction parallel to the horizontal plane and away from the first end of the housing.

12. The light fixture of claim 8, wherein the plurality of lamp units further includes a third lamp unit, the second lamp unit coupled sequentially between the first lamp unit and the third lamp unit.

* * * * *